United States Patent [19]

Uhlig

[11] Patent Number: 4,619,078

[45] Date of Patent: Oct. 28, 1986

[54] GRINDING MACHINE WITH PROTECTIVE HOOD FOR THE GRINDING WHEEL

[75] Inventor: Uwe Uhlig, Buchholz, Fed. Rep. of Germany

[73] Assignee: Hauni-Werke Körber & Co. KG., Hamburg, Fed. Rep. of Germany

[21] Appl. No.: 622,709

[22] Filed: Jun. 20, 1984

[30] Foreign Application Priority Data

Jun. 29, 1983 [DE] Fed. Rep. of Germany ..... 3323424

[51] Int. Cl.[4] ..... B24B 7/00

[52] U.S. Cl. ..... 51/5 D; 51/267; 51/268; 125/13 SS

[58] Field of Search ..... 51/5 D, 268, 267; 125/13 SS

[56] References Cited

U.S. PATENT DOCUMENTS

| | | | |
|---|---|---|---|
| 1,910,649 | 5/1933 | Svebelius | 51/268 |
| 2,707,854 | 5/1955 | Johnson | 51/268 |
| 2,914,892 | 12/1959 | Fouquet | 51/267 |
| 3,146,553 | 9/1964 | Hensley | 51/268 |
| 3,543,451 | 12/1970 | Smith | 51/268 |
| 4,024,674 | 5/1977 | Suzuki | 51/268 |
| 4,060,942 | 12/1977 | White et al. | 51/268 |
| 4,186,529 | 2/1980 | Huffman | 51/165 TP |

FOREIGN PATENT DOCUMENTS

| | | | |
|---|---|---|---|
| 2015751 | 11/1980 | Fed. Rep. of Germany | 51/268 |
| 791601 | 3/1958 | United Kingdom | 51/268 |
| 2014885 | 9/1979 | United Kingdom | 51/5 D |

*Primary Examiner*—James G. Smith

*Attorney, Agent, or Firm*—Peter K. Kontler

[57] ABSTRACT

A surface grinding machine wherein the grinding wheel is partially surrounded by a hood which can be turned about the axis of the grinding wheel in dependency on the shape and level of that part of a workpiece which is then treated by the grinding wheel. The hood carries coolant discharging nozzles which are continuously directed toward the location of contact between the grinding wheel and the workpiece. For this purpose, the nozzles are adjustable relative to the hood by discrete motors so as to compensate for wear upon and the resulting reduction of the diameter of the grinding wheel, or the hood is movable with the nozzles radially of the grinding wheel. The angular movements of the hood are shared by a dressing apparatus which is movable radially of the grinding wheel so that the dressing tool can treat the grinding wheel while the machine is in actual use.

15 Claims, 6 Drawing Figures

GRINDING MACHINE WITH PROTECTIVE HOOD FOR THE GRINDING WHEEL

BACKGROUND OF THE INVENTION

The present invention relates to machine tools in general, especially to grinding machines, and more particularly to improvements in machine tools of the type wherein the material removing tool or tools are partially surrounded by a protective hood which reduces the likelihood of injury as well as the likelihood of contamination of the surrounding area by fragments of removed material and/or sprays of liquid coolant or the like.

A surface grinding machine normally comprises a frame, at least one rotary spindle which is mounted in the frame and carries one or more grinding wheels, a work holder, combined guide and drive means for effecting a relative movement between the grinding wheel or wheels on the spindle and the workpiece on the holder so as to treat selected portions of or the entire workpiece, and a protective hood or shroud which at least partially surrounds the grinding wheel(s) and can be provided with means for supplying one or more sprays or streams of coolant, at least into the zone of contact between the grinding wheel(s) and the workpiece.

The protective hood or shroud should be placed as close to the adjacent surface of the workpiece as possible for obvious reasons. On the other hand, the hood should not come into actual contact with the workpiece. Such optimum positioning of the hood presents no problems when the surface to be treated by one or more grinding wheels is flat, i.e., the open side of the hood is then placed into immediate proximity of the path of movement of the surface which requires treatment so as to reduce to a minimum the likelihood of splashing of coolant and/or spraying of removed material as well as to protect the attendants from injury and/or discomfort. However, if the workpiece has an uneven (e.g., convex, concave or undulate) surface which is to be treated and/or formed by the grinding wheel(s), the distance between the hood and the workpiece must be selected with a view to ensure that the topmost portion of the surface also does not actually contact the hood while the workpiece is caused to move relative to the hood and grinding wheel(s) and/or vice versa. In other words, it can happen that the hood is located at a considerable distance from the workpiece during certain stages of a grinding operation upon a workpiece having a highly uneven profile with pronounced hills and valleys so that the protective or shielding effect of the hood is negligible or zero. Moreover, and as mentioned above, it is customary to install in the hood one or more nozzles or other devices which direct a liquid coolant against the region of contact between the workpiece and the grinding wheel(s). The orientation of such nozzle or nozzles is satisfactory as long as the grinding machine is to treat flat surfaces of workpieces. However, if the surfaces to be treated exhibit pronounced hills and valleys, so that the hood must be installed at a considerable distance from the path of movement of the lowermost or deepmost portions of workpieces past the grinding wheel and/or vice versa, the nozzle or nozzles discharge streams of coolant in directions other than toward the region of contact between the workpiece and one or more grinding wheels. Absence of adequate cooling of the region of contact between the grinding wheel(s) and the workpiece can affect the quality of the grinding operation and entail damage to the workpiece and/or grinding wheels as a result of insufficient lubrication and/or overheating.

OBJECTS AND SUMMARY OF THE INVENTION

An object of the invention is to provide a novel and improved grinding machine wherein the protective hood is constructed, assembled and mounted in such a way that its effectiveness cannot be unduly influenced by the configuration of workpieces which are treated by one or more grinding wheels.

Another object of the invention is to provide a grinding machine wherein the stream or streams of a fluid coolant are invariably directed against the location of contact between a workpiece and one or more grinding wheels irrespective of the dimensions and/or configuration of the workpiece and/or grinding wheel(s).

A further object of the invention is to provide a grinding machine which exhibits the above outlined features and wherein the grinding wheel or wheels can be dressed or similarly treated in the course of the grinding operation.

An additional object of the invention is to provide the grinding machine with novel and improved means for ensuring that the manner of applying a coolant to the location of contact between the workpiece and one or more grinding wheels is not affected by progressing wear upon the grinding wheel(s) as a result of dressing and/or as a result of removal of material from the workpiece.

Still another object of the invention is to provide the grinding machine with novel and improved means for supplying coolant to one or more nozzles or other suitable coolant directing devices in or on the protective hood for the grinding wheel(s).

An additional object of the invention is to provide a grinding machine wherein the protective hood is held in an optimum position irrespective of the nature and/or extent of movement of the grinding wheel(s) relative to the workpiece and/or vice versa.

A further object of the invention is to provide the grinding machine with novel and improved means for ensuring proper orientation of the protective hood as a function of one or more variable parameters such as the wear upon the grinding wheel(s), the selected path of movement of the grinding wheel(s) relative to the workpiece and/or vice versa, and/or others.

Another object of the invention a novel and improved dressing apparatus for use in a grinding machine of the above outlined character.

Still another object of the invention is to provide a novel and improved protective hood for the grinding wheel(s) of a surface grinding machine.

A further object of the invention is to provide a novel and improved method of preventing spraying of coolant and/or removed material around the work removing station in a surface grinding machine.

An additional object of the invention is to provide a grinding machine wherein the workpiece and/or the grinding wheels are invariably protected from overheating in a novel and improved way.

An ancillary object of the invention is to provide a novel and improved protective hood which can be installed and used in existing surface grinding machines and other types of machine tools as a superior substitute for heretofore known protective hoods.

One feature of the invention resides in the provision of a grinding machine which comprises a frame, a work holder which is preferably movably mounted on the frame, a rotary spindle which drives at least one grinding wheel and is mounted in the frame (e.g., for movement in the direction of the Y-axis), drive means for effecting a relative movement between the spindle and the work holder so as to enable a grinding wheel on the spindle to perform a grinding operation upon the workpiece which is mounted in or on the holder, a protective shroud or hood which is provided on the frame and serves to at least partially surround and confine the grinding wheel on the spindle, and means for changing the position of the hood relative to the frame in dependency on the configuration of the workpiece which is mounted in or on the holder. The drive means is arranged to place the grinding wheel on the spindle into contact with different portions of that surface or those surfaces of the workpiece in or on the holder which require treatment in the grinding machine, and the machine preferably further comprises at least one coolant discharging device (e.g., one or more spray nozzles for liquid coolant) which is provided on the hood and serves to direct one or more streams or sprays of coolant against the location of contact between the grinding wheel and the workpiece.

In accordance with a presently preferred embodiment of the invention, the grinding machine further comprises means for rotatably securing the hood to the frame so that the hood is angularly movable with reference to the grinding wheel on the spindle. The hood can be mounted for rotation about the axis of the spindle through an angle of 360 degrees. Thus, the securing means can define for the hood an axis of rotation which coincides with the axis of the spindle. The securing means can be mounted on a carrier for the spindle, and such carrier is preferably reciprocable along an upright column of the frame.

The grinding machine preferably further comprises a wheel dressing apparatus which is provided on the securing means for the hood so that it shares the angular movements of the hood about the axis of the spindle, and means for moving the dressing apparatus substantially radially of the spindle so that the tool or tools of the dressing apparatus can treat the working surface of a grinding wheel on the spindle while the machine is in actual use.

The source of coolant is preferably mounted in or on the frame. Therefore, the grinding machine further comprises means for conducting coolant from the source to the coolant discharging device in or on the hood. Such coolant conducting means can comprise a first section (e.g., a channel or a conduit) which is provided in or on the frame and communicates with the source, a second section (e.g., a conduit or a channel) which is provided in or on the hood and is connected with the coolant discharging device, and a coupling which delivers coolant from the first section to the second section in each angular position of the hood.

The coolant discharging device is preferably movable relative to the hood, and such grinding machine preferably further comprises means for moving the coolant discharging device relative to and/or with the hood to a position which is a function of the diameter of the grinding wheel on the spindle. This ensures that the spray or sprays or stream or streams of coolant are invariably directed against the location of contact between the working surface of the grinding wheel on the spindle and the workpiece on the holder irrespective of gradual changes in the diameter of the grinding wheel as the wear upon the grinding wheel progresses due to repeated dressing and/or as a result of material-removing engagement with workpieces.

Instead of movably mounting the coolant discharging device on the hood, or in addition to such movability of the coolant discharging device, the hood can be mounted on the spindle carrier for movement radially of the spindle so as to compensate for gradual reduction of the diameter of the grinding wheel by moving radially of the spindle together with the coolant discharging device when the need arises. Such hood is then preferably movable by two discrete drive means, namely by the position changing means for moving it angularly relative to the grinding wheel on the spindle and by the means for moving it radially of the spindle. The hood is preferably movable to any one of a practically infinite number of positions, as considered radially of the spindle, so that it can change its position at the same rate at which the diameter of the grinding wheel on the spindle decreases. However, it is also possible to provide for incremental changes in the position of the hood, as considered in the radial direction of the spindle. As mentioned above, the position changing means is preferably designed to change the position of the hood as a function of the profile of the workpiece which is being treated by the grinding wheel on the spindle. This can be readily achieved with resort to means for scanning the profile of the workpiece and/or by the provision of means for calculating the profile of the workpiece from data which are available prior to start of a grinding operation and/or in the course of a grinding operation. For example, the position changing means can comprise or can be operated by a programmed control unit.

Another feature of the invention resides in the provision of a machine tool (such as a surface grinding machine) which comprises a frame, a rotary material removing tool which is mounted in the frame or in another suitable support for the tool, a protective hood for the tool, means for movably securing the hood to the support, and means for moving the hood relative to the support. The securing means preferably defines an axis about which the hood is rotatable relative to the support, and such axis can coincide with the axis of the rotary tool. The moving means preferably includes or is associated with means for moving the hood as a function of the contour of the workpiece which is being treated by the rotary tool. For example, if the tool is arranged to orbit about a workpiece along a circular, heart-shaped, kidney-shaped, oval or otherwise configurated path so as to be in a position to treat each and every portion of the exterior of a workpiece in the form of a propeller blade, turbine blade or the like, the means for moving the hood can be designed to change the orientation of the hood relative to the tool and the workpiece in response to movement of the tool into different portions of its path so that the open side of the hood always remains as close to the workpiece as possible in view of the configuration of the workpiece but without actually touching the workpiece.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
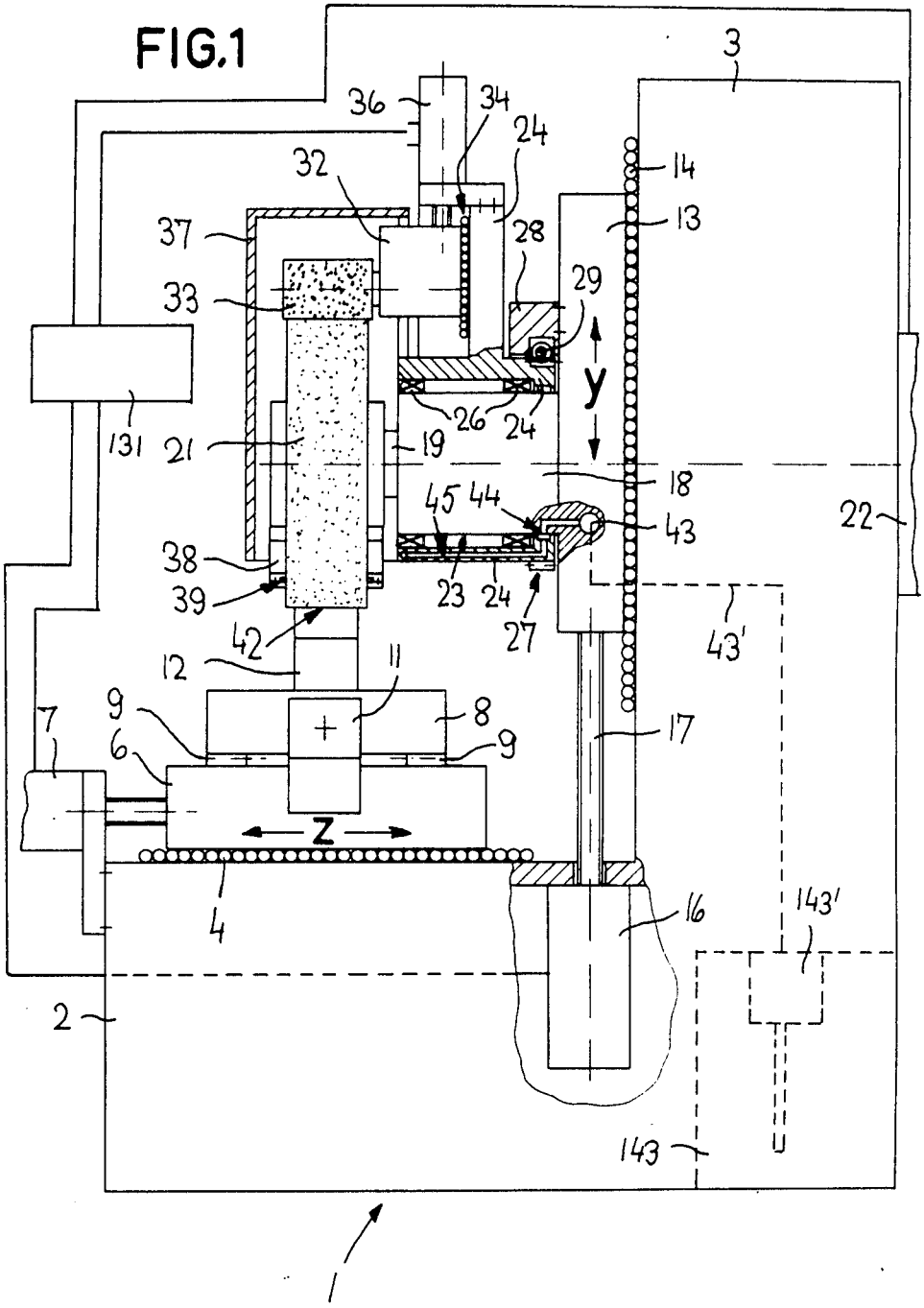
FIG. 1 is a schematic side elevational view of a grinding machine which embodies one form of the invention, portions of the frame, of the hood and of certain other components of the machine being shown in a vertical sectional view.
Figure 2:
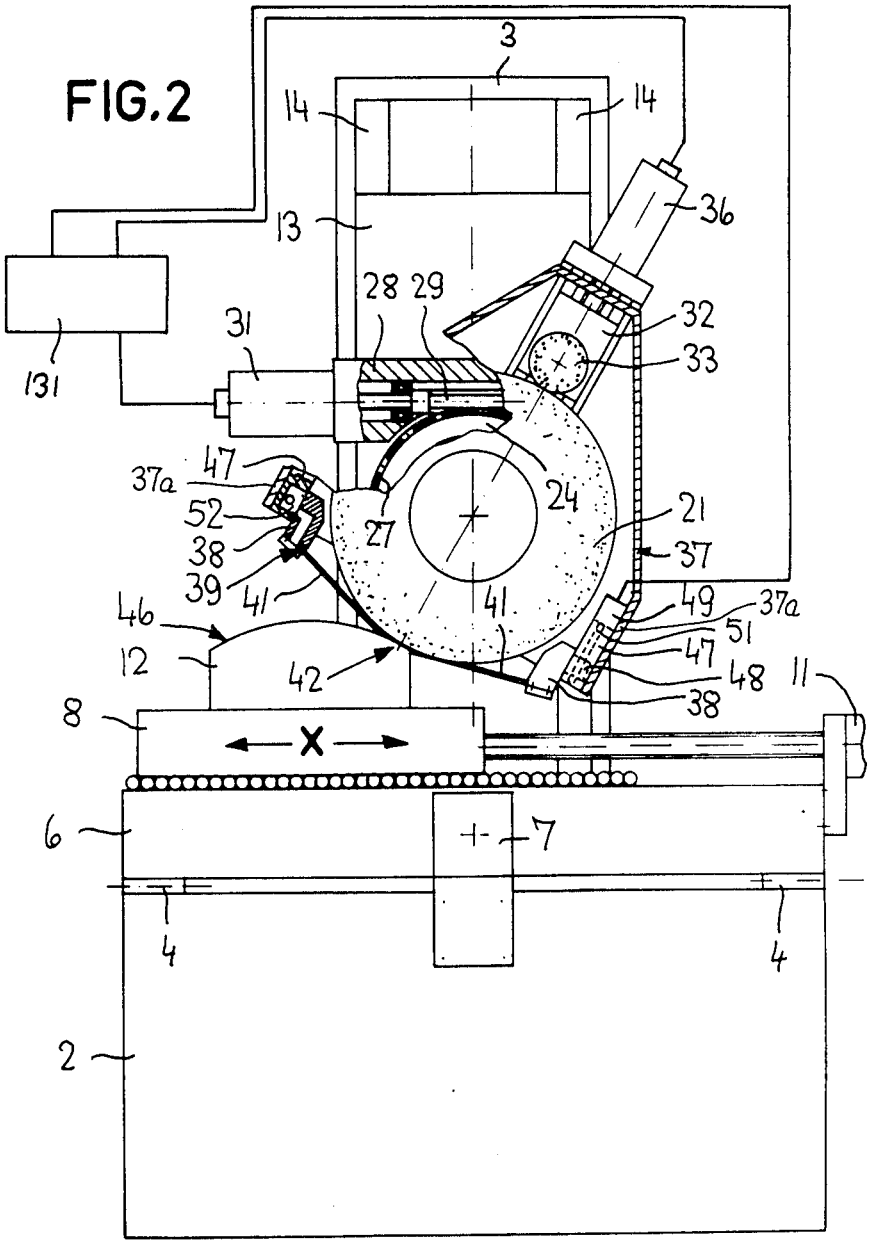
FIG. 2 is a schematic front elevational view of the grinding machine as seen from the left-hand side of FIG. 1, with a portion of the hood and certain other parts broken away and with the holder for the workpiece shown in one of its end positions.
Figure 3:
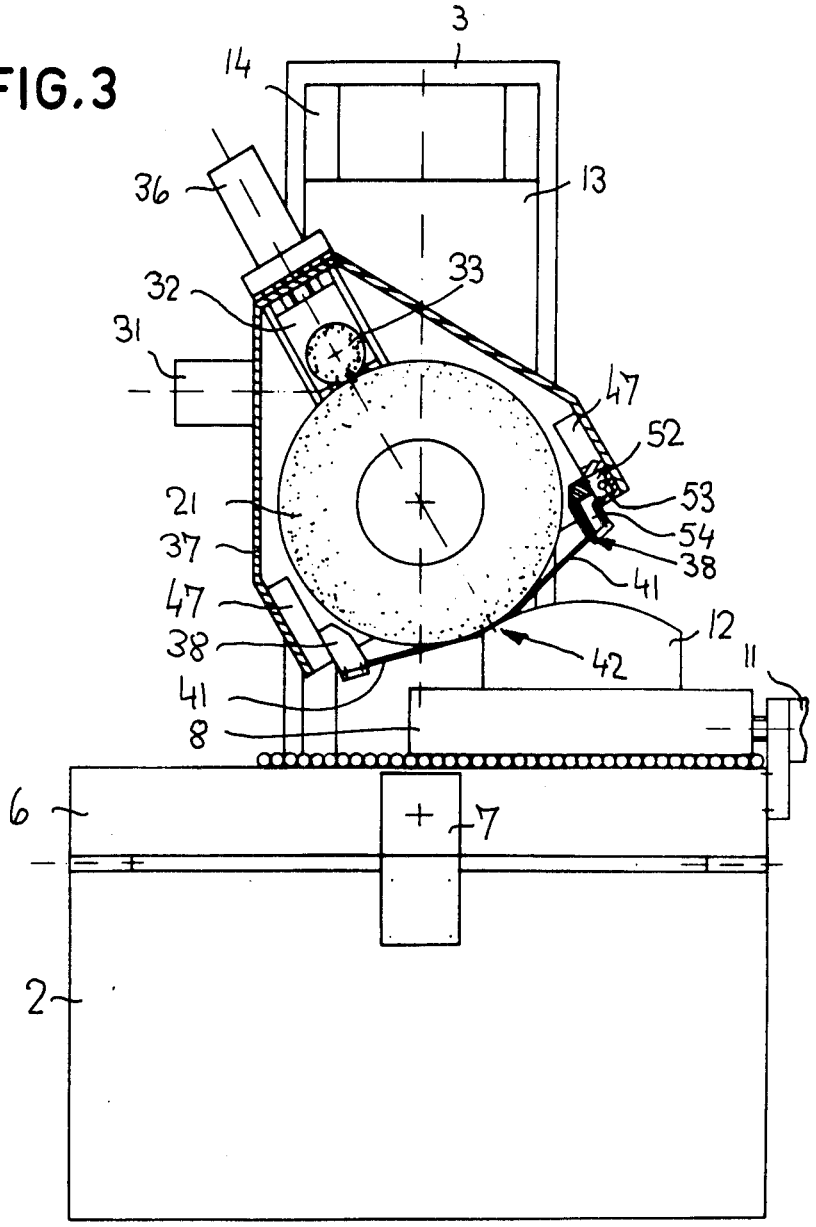
FIG. 3 illustrates the structure of FIG. 2 but with the holder of the workpiece in another end position.

Referring first to FIGS. 1 to 3, there is shown a surface grinding machine whose frame or support 1 includes a base or bed 2 and a column 3 which may but need be integral with and extends to a level well above the base. The base 2 carries precision bearings 4 for a horizontal carriage 6 which is reciprocable by a suitable motor 7 in directions indicated by the double-headed arrow Z. The illustrated precision bearings 4 are roller bearings, and similar roller bearings 9 are provided on top of the carriage 6 for a horizontal table 8 which is reciprocable in directions indicated by a double-headed arrow X. The drive means for moving the table 8 relative to the carriage 6 is shown at 11. The table 8 constitutes a holder for a workpiece 12 having a convex surface 46 which requires treatment in the grinding machine. The profile of the workpiece 12 can be much more complex than that which is shown at 46; e.g., the workpiece can have an undulate surface which must be treated by the working surface or surfaces of one or more grinding wheels. The manner in which the workpiece 12 is releasably affixed to the table or holder 8 is not specifically shown in the drawing. It suffices to say that the illustrated workpiece 12 is mounted in a way to share all movements of the table or holder 8 but that the latter can be provided with means for moving the workpiece 12 relative thereto if such movements of the workpiece with reference to its holder are desirable or advantageous for proper treatment of the surface 46.

The front side of the column 3 is provided with a precision roller bearing 14 for a carriage 13 which is movable up and down in directions indicated by a double-headed arrow Y and supports a carrier 18 for a horizontal spindle 19. The latter carries one or more coaxial grinding wheels 21. FIGS. 1 to 3 show a single grinding wheel. The carriage 13 is movable up and down by a vertical feed screw 17 which can receive torque from a reversible motor 16. The means for rotating the spindle 19 and the grinding wheel 21 thereon comprises a motor 22 or another suitable prime mover.

That end portion of the spindle carrier 18 which is adjacent to the grinding wheel 21 constitutes a cylinder with a precision-finished cylindrical external surface 23 whose axis coincides with the common axis of the spindle 19 and grinding wheel 21 and which is surrounded by the complementary cylindrical internal surface of a sleeve 24 constituting a means for movably securing a hood or shroud 37 to the frame 1, namely to the carrier 18. The sleeve 24 rotates on suitable antifriction bearings 26 which surround the cylindrical surface 23 of the carrier 18. The sleeve 24 is formed with an annulus of external teeth 27 constituting a gear in mesh with a worm 29 which is rotatably mounted in a housing 28 and can receive torque from a motor 31. The housing 28 is mounted on the carriage 13.

The sleeve 24 further supports a dressing apparatus 32 having a dressing tool in the form of a roller or wheel 33 which can treat the working surface of the grinding wheel 21 on the spindle 19. The dressing apparatus 32 is movable along precision roller bearings 34 which are provided therefor on the sleeve 24 and enable the apparatus to move radially of the grinding wheel 21. The drive means for moving the apparatus 32 radially of the spindle 19 and grinding wheel 21 is shown at 36. The housing of the dressing apparatus 32 further contains a motor (not specifically shown) which can be actuated to rotate the dressing tool 33.

As mentioned above, the sleeve 24 supports the hood 37 so that the latter can rotate with the sleeve about the common axis of the spindle 19 and grinding wheel 21, preferably through 360 degrees. Thus, when the worm 29 is rotated by the motor 31 to rotate the sleeve 24 about the cylindrical surface 23 of the carrier 18, the hood 37 shares such angular movement of the sleeve 24 and changes its angular position relative to the grinding wheel 21 and relative to the workpiece 12 on the table or holder 8.

The inner sides of the two marginal portions 37*a* adjacent to the open side or end of the hood 37 support discrete coolant discharging devices 38 which serve to direct sprays or streams 41 of a suitable liquid coolant against the location 42 of contact between the peripheral working surface of the grinding wheel 21 and the surface 46 of the workpiece 12. Each of the devices 38 can be formed with an elongated slot-shaped orifice 39 which discharges a relatively narrow but wide spray or stream 41 of liquid coolant (the width of such spray or stream 41 preferably equals or even exceeds the axial length of the grinding wheel 21). Alternatively, the slot-shaped orifice 39 can be replaced with a row of discrete circular orifices each of which discharges a spray or stream toward the location 42.

The source 143 of liquid coolant is installed besides the frame 1. The means for conducting liquid coolant from the source 143 to the orifices 39 of the coolant discharging devices or nozzles 38 comprises a conduit or channel 43 which is machined into the carriage 13 and communicates with the source 143 by means of flexible pipes 43', a pump 143', conduits or channels 45 provided in or on the hood 37 and communicating with the devices 38, and a coupling device 44 which establishes a path for the flow of coolant from the channel 43 to the channels 45 in each angular position of the sleeve 24 and hood 37 relative to the carrier 18 and carriage 13. The latter can be said to constitute a movable portion of the frame 1. The exact construction of the coupling device 44 forms no part of the invention; it suffices to say that such device should be capable of delivering requisite quantities of coolant to the devices 38 without any or without appreciable leakage of coolant in the region between the carriage 13 and carrier 18 on the one hand and the sleeve 24 and hood 37 on the other hand.

FIG. 2 shows the table 8 and the workpiece 12 thereon in one end position with reference to the carriage 6 and base 2. The peripheral working surface of the grinding wheel 21 on the spindle 19 is in the process of treating the rightmost portion of the convex surface 46 of the workpiece 12 and the devices 38 direct sprays or streams 41 of coolant against the location 42 of contact between the working surface of the grinding wheel 21 and the surface 46 of the workpiece 12. This is due to the fact that the motor 31 has caused the worm 29 to change the angular position of the sleeve 24 and hood 37 with reference to the grinding wheel 21 so that the hood offers maximum protection to a person standing by and prevents spraying of liquid coolant and/or propulsion of removed solid material into the surrounding atmosphere. In the absence of movability of the sleeve 24 about the common axis of the spindle 19 and grinding wheel 21, the marginal portions 37*a* of the hood 37 would have to be placed at a much greater distance from the table 8 and the workpiece 12 thereon in order to avoid actual contact between the workpiece and the hood in response to movement of the table 8 in the directions which are indicated by the arrow X. This would considerably reduce the effectiveness of the hood 37. Moreover, in the absence of movability of the hood 37 relative to the grinding wheel 21, the convex surface 46 of the workpiece 12 would interfere with propulsion of droplets of coolant to the location 42, at least in certain positions of the table 8, i.e., the surface 46 would be located in the path of at least one of the streams or sprays 41 which would greatly reduce the effectiveness of the cooling operation upon the workpiece 12 and grinding wheel 21. The likelihood of interception of the one or the other stream or spray 41 by the convex surface 46 (in the absence of angular movability of the hood 37 and its coolant discharging devices 38 about the axis of the spindle 19) would be particularly pronounced during grinding of those portions of the surface 46 which are nearest to the table 8.

The operation of the motor 31 is selected in such a way that it changes the angular position of the sleeve 24 and hood 37 as a function of progressing changes of the surface (contour) 46 of the workpiece 12 on the table 8. In the embodiment of FIGS. 1 to 3, and as shown in FIGS. 2 and 3, the motor 31 changes the angular position of the hood 37 in such a way that the central symmetry plane of the hood (such plane includes the axis of the spindle 19 and also the location (line) 42 of contact between the grinding wheel 21 and the workpiece 12) is always normal to that portion or increment of the surface 46 which is being treated by the grinding wheel. FIGS. 2 and 3 show the two extreme angular positions of the hood 37 and sleeve 24 during treatment of the convex surface 46 of the workpiece 12. The hood 37 preferably assumes a substantial or even an infinite number of intermediate positions while the treatment of the surface 46 progresses from the right-hand end (FIG. 2) to the left-hand end (FIG. 3). Angular movability of the hood 37 invariably ensures that its effectiveness does not decrease during treatment of workpieces whose surfaces are not flat but rather concave, convex or undulate or deviate otherwise from easy-to-treat configurations or contours. Moreover, the hood 37 also changes the angular positions of the coolant discharging devices 38 so that the sprays or streams 41 remain directed against the location 42 irrespective of the exact position of such location, i.e., irrespective of whether the location 42 is nearer to the one or to the other end of the convex surface 46.

The control unit which transmits signals to the motor 31 so as to change the angular position of the hood 37 as a function of the configuration of the workpiece 12 is shown schematically at 131. Such control unit causes the motor 31 to transmit motion to the hood 37 and its coolant discharging devices 38 via worm 29, gear 27 and sleeve 24. The control unit 131 can receive signals from or can comprise a computer which can transmit output signals on the basis of information which has been supplied thereto and is indicative of the configuration of that portion of the workpiece 12 which requires treatment by the grinding wheel 21. The information which is stored in the computer of or for the control unit 131 further includes data pertaining to the dimensions and configuration of the hood 37 so that the computer can evaluate such information for the purpose of adequately controlling the motor 31 and hence the angular position of the hood 37. The regulation is such that the marginal portions 37*a* of the hood 37 remain as close to the workpiece 12 as possible but do not interfere with movements of the workpiece in the directions which are indicated by the arrow X. In other words, the computer ensures that the hood 37 invariably assumes an optimum angular position irrespective of the configuration of that surface of the workpiece 12 which requires treatment by the grinding wheel 21.

FIG. 2 shows certain details of the coolant discharging devices 38. As shown in the right-hand portion of the hood 37, the corresponding device 38 is reciprocable in a receiver 47 at the inner side of the respective marginal portion 37*a*. To this end, the device 38 comprises a threaded extension 48 which is engaged by a worm 51 arranged to receive motion from a drive 49, e.g., a suitable electric motor. The drive 49 is operated in dependency on changes in the diameter of the grinding wheel 21. This ensures that the orifices 39 of the devices 38 invariably direct the respective sprays or streams 41 against the location 42 of contact between the grinding wheel 21 and the workpiece 12. In other words, the drive 49 can account for the fact that the diameter of the grinding wheel 21 decreases as a result of intermittent or continuous dressing by the tool 33 of the apparatus 32 and/or as a result of material-removing engagement with the workpiece on the table 8. The drive 49 receives appropriate signals from a mechanical sensor or a photoelectric detector (not shown) which monitors the diameter of the grinding wheel 21.

The manner in which the liquid coolant is supplied to the orifices 39 of the coolant discharging devices 38 is shown in the right-hand portion of the hood 37 of FIG. 3. The receiver 47 for the extension 48 of the respective device 38 has a channel or bore 52 which receives coolant from a conduit 53 which, in turn, communicates with the respective conduit or channel 45 of the coolant conducting means 43–45. The channel or bore 52 communicates with a channel or bore 54 in the body of the respective device 38 in such a way that the channels 52, 54 continue to communicate with one another irrespective of the fact that the extension 48 is movable relative to the respective receiver 47. The orifice 39 communicates with the channel 54. The conducting means 43–45 delivers the coolant under requisite pressure so that the orifices 39 can discharge satisfactory sprays or streams 41, i.e., that the location 42 receives a certain quantity of coolant per unit of time.

The dressing apparatus 32 shares the angular movements of the sleeve 24 and hood 37 about the axis of the spindle 19. This can be readily seen by comparing FIGS. 2 and 3 which show the dressing apparatus 32 in two different angular positions. Since the tool 33 is movable radially of the spindle 19 irrespective of the angular position of the hood 37, such tool can treat the working surface of the grinding wheel 21 at the time when the latter is in contact with the surface 46 of the workpiece 12 on the table or holder 8. This contributes to more effective grinding operation because the working surface of the grinding wheel 21 is always in an optimum condition for adequate treatment of the surface 46.

In lieu of providing means for reciprocating the coolant discharging devices 38 relative to the respective marginal portions 37*a* of the hood 37, it is also possible to ensure continuous propulsion of liquid coolant against the location 42 by employing liquid discharging devices which are pivotably mounted in the hood 37. Thus, the motors 51 are then designed to change the angular positions of the respective devices 38 as a function of changes in the diameter of the grinding wheel 21 so as to ensure that the streams or sprays 41 are always directed against the location 42 of contact between the grinding wheel and the workpiece 12. The transmission between each motor 51 and the respective device 38 can comprise a simple bevel gear transmission, a planetary or another gear transmission or a rack-and-pinion drive with the rack moved by the respective motor 51 and with the pinion connected to and arranged to change the angular position of the respective coolant discharging device 38.

A further possibility of effectively compensating for changes in the diameter of the grinding wheel 21 so as to ensure continuous impingement of sprays or streams 41 upon the location 42 is to mount the hood 37 for movement radially of the spindle 19 and the grinding wheel 21 thereon. In such grinding machine, the coolant discharging devices 38 can be rigidly affixed to the respective marginal portions 37*a* because the hood 37 can be moved radially of the spindle 19 at the rate which is required to fully compensate for a reduction of the diameter of the grinding wheel 21 when the machine of FIGS. 1 to 3 is in actual use or when the machine is not in use but the dressing apparatus 32 is actuated to treat the working surface of the grinding wheel 21. The means for moving the hood 37 radially of the spindle 19 (in addition to angular movement of the hood about the axis of the grinding wheel 21) can be similar or analogous to the means 36 for moving the dressing apparatus 32 radially of the grinding wheel.

Figure 4:
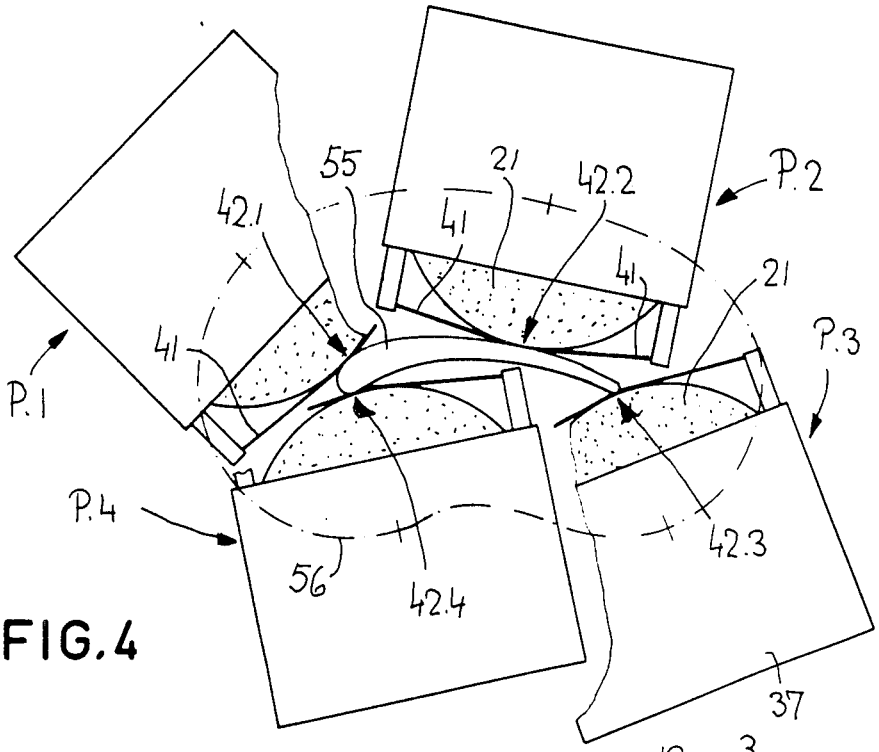
FIG. 4 is an enlarged view of a detail in a modified grinding machine, substantially as seen in the direction of arrow IV in FIG. 5, with the grinding wheel and its hood shown in four different positions.
Figure 5:
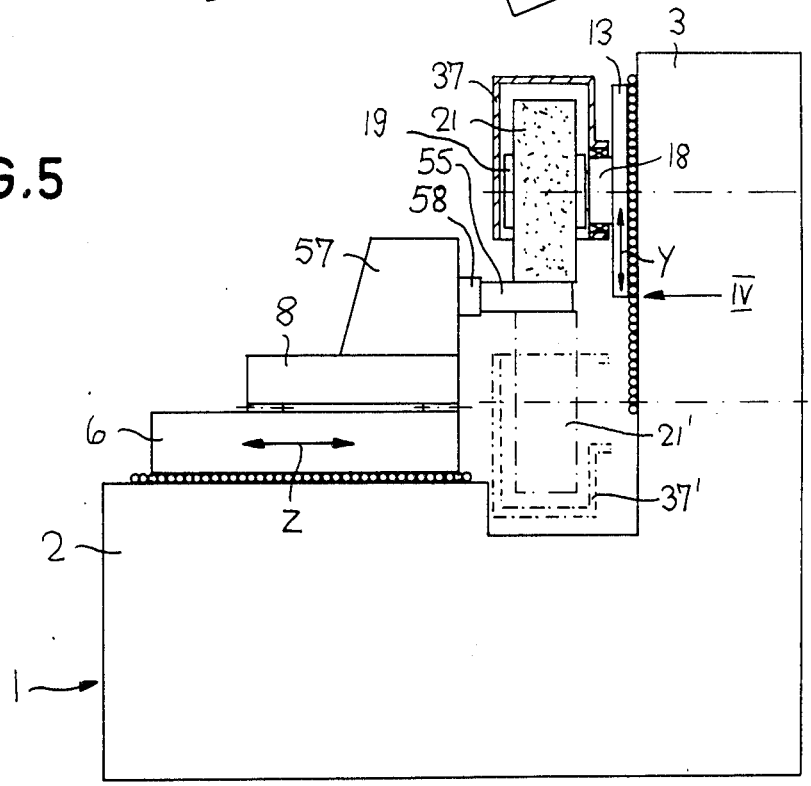
FIG. 5 is a schematic partly side elevational and partly vertical sectional view of the grinding machine which embodies the structure of FIG. 4.

FIGS. 4 and 5 show a modified grinding machine which can be used for the treatment of workpieces 55 in the form of propeller or turbine blades. The carrier 18 for the spindle 19 and grinding wheel 21 is mounted in the machine frame in such a way that it can move the common axis of the spindle and grinding wheel along an endless kidney-shaped path 56 which is indicated in FIG. 4 by a phantom line. This enables the grinding wheel 21 to treat the entire external surface of the workpiece 55. Such treatment necessitates practically continuous changes in the position of the grinding wheel 21 and hence practically continuous changes in the angular position of the hood 37 relative to the grinding wheel. Four different positions of the grinding wheel 21 and the corresponding angular positions of the hood 37 are shows at P.1, P.2, P.3 and P.4. The grinding operation is preferably continuous, i.e, the common axis of the grinding wheel 21 and its spindle 19 is caused to move along the endless path 56 at a rate which is required to continuously treat the external surface of the workpiece 55. It is not necessary that the grinding wheel 21 alone perform the movement along the path 56; an equivalent mode of operation can be achieved by changing the angular position of the workpiece 55 relative to its holder 57 and/or carriage 6 simultaneously with vertical changes in the position of the grinding wheel 21.

FIG. 4 shows quite clearly that the angular position of the hood 37 in different positions of the axis of the grinding wheel 21 relative to the workpiece 55 is such that the protective or shielding effect of the hood 37 is always at an optimum value, i.e., that the hood reduces the likelihood of spraying of removed material and/or coolant into the surrounding atmosphere and that the hood also shields or surrounds a substantial part of the region immediately adjacent the location of contact between the grinding wheel and the external surface of the workpiece 55. Four such locations are respectively shown at 42.1, 42.2, 42.3 and 42.4. Moreover, the streams or sprays 41 of liquid coolant are always directed against the respective locations 42.1 to 42.4 in each and every position of the hood 37 and grinding wheel 21. Such predictable spraying of liquid coolant and optimum orientation of the hood 37 ensure the establishment and maintenance of optimum conditions for effective operation of the grinding machine.

Basically, the construction of the grinding machine of FIG. 5 is the same as or analogous to that of the grinding machine which is shown in FIGS. 1 to 3. Therefore, the parts of the machine of FIG. 5 are denoted by similar reference characters. The column 3 of the frame 1 supports the vertically movable carriage 13 (arrow Y) which, in turn, supports the carrier 18 for the spindle 19. The hood 37 is mounted on the carrier 18 for angular movement about the common axis of the spindle 19 and grinding wheel 21.

The bed 2 of the frame 1 supports a carriage 6 which is reciprocable in directions indicated by the arrow Z, and the table 8 on the carriage 6 is reciprocable with reference to the latter at right angles to the plane of FIG. 5. The table 8 supports the work holder 57 which has a clamping device 58 for the workpiece 55. The latter extends from the clamping device 58 in cantilever fashion so that it can be treated from all sides while the axis of the grinding wheel 21 is caused to advance along the endless path 56. The uppermost position of the grinding wheel 21 is shown in FIG. 5 by solid lines, and its lowermost position is shown by phantom lines, as at 21'; such lowermost position corresponds or is close to the position P.3 or P.4 of FIG. 4. The hood 37 is then turned practically upside down and assumes the phantom-line position 37' of FIG. 5. The open side of the hood 37 then faces upwardly, i.e., toward the concave underside of the workpiece 55.

An important advantage of the improved grinding machine and its hood 37 is that the position of the hood is always best suited for confinement of the coolant and removed material irrespective of the configuration of that surface or those surfaces of the workpiece which require treatment by the grinding wheel. As mentioned above, such optimum position is achieved by properly orienting the hood 37 relative to the grinding wheel 21 as well as by properly selecting the distance between the open side of the hood and the workpiece 12 or 55. Thus, the improved grinding machine ensures that the protective or shielding action of the hood 37 is not affected by the shape of the workpiece and/or by the path along which the axis of the spindle 19 must be moved in the course of a grinding operation.

Another important advantage of the improved grinding machine is that the coolant is not wasted while the machine is in use because the manner of mounting the coolant discharging devices 38 on and the movability of such devices with and/or relative to the hood 37 are such that the sprays or streams 41 of liquid coolant are always directed toward and trained upon the location of contact between the grinding wheel and the workpiece.

While it is possible to provide for the hood 37 a separate arrangement which secures it to the frame 1 of the grinding machine, the illustrated arrangement (wherein the securing means or sleeve 24 is mounted on the carrier 18 for the spindle 19 and grinding wheel 21) is preferred at this time because it contributes to compactness of the machine and ensures that the hood can rotate about the common axis of the spindle 19 and grinding wheel or wheels on the spindle.

A further important advantage of the improved grinding machine is that the dressing apparatus 32 is movable with the hood 37 as well as radially of the spindle 19 so that it can treat the working surface of the grinding wheel 21 while the machine is in actual use. This reduces the down times because the working surface 21 can be held in optimum condition during each and every stage of a grinding operation.

An additional important advantage of the improved grinding machine is that the source 143 of coolant need not be mounted on the hood 37 in spite of the fact that the coolant discharging devices 38 are mounted on and share the movements of the hood. This renders it possible to provide a relatively large source of coolant, either on the stationary part 2 or 3 of the frame 1 or on a mobile part (such as the carriage 13) of the frame.

Still another important advantage of the improved grinding machine is that the wear upon the grinding wheel 21 (as a result of dressing by the tool 33 and/or as a result of engagement with the workpiece) does not affect the accuracy with which the devices 38 aim streams or sprays 41 of coolant against the location 42 of contact between the grinding wheel and the workpiece. As mentioned above, this ensures adequate cooling of the affected parts and reduces the likelihood of wasting substantial quantities of coolant in the course of a grinding operation. As also mentioned above, the devices 38 need not be movable relative to the hood 37 if the latter is movable radially of the spindle 19 for the purpose of compensating for wear upon the grinding wheel. In such grinding machine, the two motors 51 are replaced with a single motor which can move the hood 37 radially of the spindle 19 as a function of changes in the diameter of the grinding wheel 21.

A further important (but optional) feature of the improved grinding machine is that the hood 37 can turn around the axis of the grinding wheel 21 through 360 degrees. The advantages of such mounting of the hood have been pointed out with reference to FIG. 4, i.e., the grinding wheel can be caused to treat the entire exterior of a workpiece in a single pass with attendant savings in time and higher output of the machine. As mentioned above, the grinding machine is preferably equipped with a programmable control system for the means which moves the hood 37 about the axis of the grinding wheel 21 to thus ensure that the hood will invariably assume an optimum position with reference to the workpiece irrespective of the configuration of the workpiece and/or the nature of the path along which the workpiece must move relative to the grinding wheel and/or vice versa. The exact manner in which such control system is programmed to ensure optimum positioning of the hood 37 during each stage of a grinding operation forms no part of the invention. As mentioned above, such programming is carried out by taking into consideration a number of parameters including the outline of the surface of the workpiece and the dimensions of the hood as well as the path along which the axis of the grinding wheel must be moved in the course of a grinding operation. In this manner, the distance between the open end of the hood 37 and the adjacent surface of the workpiece can be kept to a minimum while the hood is held out of actual contact with the workpiece.

The improved mounting of the hood, of the coolant applying devices and of the dressing apparatus is especially desirable in a surface grinding or another grinding machine. However, such features can be incorporated with equal advantage or with similar advantage in many other types of machine tools without departing from the spirit of the invention. Thus, such a hood can be used in any machine tool wherein it is desirable and advantageous to change the position of the hood relative to the tool and/or workpiece in dependency upon the configuration of that surface or those surfaces of the workpiece which requires or require treatment in the machine tool.

If the spindle 19 carries two or more grinding wheels, the machine can be provided with a discrete hood for each grinding wheel or with a single hood which confines all grinding wheels. Furthermore, if the machine has two or mor spindles each of which carries one or more grinding wheels or other types of material removing tools (such as lapping or polishing tools), the machine will be equipped with several hoods, at least one for each spindle. Many additional modifications of the illustrated and described machine are also within the spirit of the invention.

Figure 6:
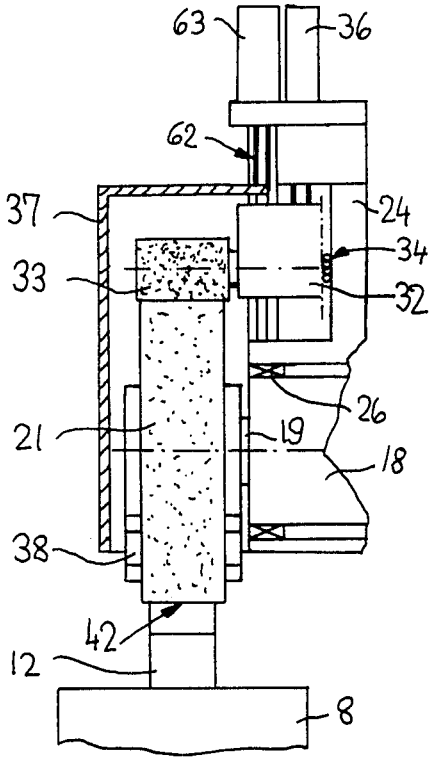
FIG. 6 is a fragmentary vertical sectional view of a machine wherein the hood is movable radially of the grinding wheel.

FIG. 6 shows schematically a differently mounted hood 37. The nozzles 38 are fixedly mounted at the lower edges of the hood 37 for directing sprays or streams of liquid coolant against the location 42 of contact between the peripheral working surface of the grinding wheel 21 and the surface of the workpiece 12. The design of the nozzles 38 may be the same as described above in connection with FIGS. 1 and 2. The hood 37 is movable radially of the spindle 19 along bearing 62 mounted on the front part of the sleeve 24 which is rotatably mounted on the carrier 18. A numerically controlled motor 63 is provided for linear movement of the hood 37 radially of the spindle 19. The design of the other parts of the grinding machine may be the same as described above.

In FIGS. 1 and 2 there schematically is shown a control unit which is 131 connected to the driving and controlling means of the machine. The control unit 131 is adapted to numerically control the operation of the motor 31 for changing the angular position of the hood 37 in dependency on the configuration of the surface 46 of the workpiece and in dependency on the parameters of the hood and also to numerically control at least some other functions of the machine inclusive of motors 51 to change the positions of the nozzles 38. The control unit 131 may be a unit named "Sinumerik System 8" produced by Siemens AG, München/Erlangen, Western Germany.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A grinding machine comprising a frame; a work holder on said frame; a rotary spindle for at least one grinding wheel on said frame; drive means for effecting relative movement between said spindle and said holder so as to enable a wheel on said spindle to carry out a grinding operation upon the workpiece on said holder; a protective hood provided on said frame and arranged to partially surround the grinding wheel on said spindle; and means for automatically changing the position of said hood relative to said frame in dependency on the configuration of the workpiece on said holder while the grinding wheel on said spindle removes material from such workpiece and the workpiece is out of contact with the hood.

2. The machine of claim 1, wherein the grinding wheel on said spindle is arranged to treat workpieces of the type having a predetermined profile and said drive means is arranged to place the grinding wheel into material-removing contact with different portions of the profile of the workpiece on said holder, and further comprising at least one coolant discharging device provided on said hood and arranged to direct coolant against the location of contact between the grinding wheel on said spindle and the workpiece on said holder.

3. The machine of claim 2, further comprising means for rotatably securing said hood to said frame so that the hood is angularly movable with reference to the grinding wheel on said spindle.

4. The machine of claim 3, wherein said securing means defines for said hood an axis which coincides with the axis of said spindle.

5. The machine of claim 4, further comprising a carrier for said spindle, said carrier being installed in said frame and said securing means being rotatably mounted on said carrier.

6. The machine of claim 5, further comprising a wheel dressing apparatus provided on said securing means and arranged to share the angular movements of said hood about said axis, and means for moving said apparatus substantially radially of said spindle.

7. The machine of claim 3, further comprising a source of coolant in said frame, and means for conducting coolant from said source to said coolant discharging device, said coolant conducting means comprising a first section provided on said frame and communicating with said source, a second section provided on said hood and communicating with said device, and a coupling for delivering coolant from said first to said second section in each angular position of said hood.

8. The machine of claim 3, wherein said coolant discharging device is movable relative to said hood, and further comprising means for moving said device relative to said hood to a position which is a function of the diameter of the grinding wheel on said spindle.

9. The machine of claim 3, further comprising a carrier for said spindle, said carrier being installed in said frame and said securing means being rotatably mounted on said carrier, said hood being movable relative to said securing means substantially radially of said spindle and further comprising means for moving said hood relative to said securing means.

10. The machine of claim 9, wherein said moving means is arranged to move said hood to any one of a plurality of different positions each of which is a function of a different grinding wheel diameter.

11. The machine of claim 4, wherein said hood is rotatable about the axis of said spindle through 360 degrees.

12. The machine of claim 3, wherein said position changing means comprises means for moving said hood as a function of the profile of the workpiece on said holder.

13. The machine of claim 12, wherein said moving means includes a programmable control unit.

14. In a grinding machine, a rotary material removing tool; a support for said tool; a protective hood for said tool; means for movably securing said hood to said support, said securing means defining an axis about which said hood is rotatable relative to said support; and means for automatically moving said hood relative to said support while said tool is in the process of removing material from a workpiece and the hood is out of contact with such workpiece, said moving means including means for moving the hood as a function of the contour of the workpiece which is being treated by said tool.

15. The structure of claim 14, wherein said axis is the axis of said tool.

* * * * *